US005238433A

United States Patent [19]

Hayasaka

[11] Patent Number: 5,238,433

[45] Date of Patent: Aug. 24, 1993

[54] COVER FOR THE INBOARD-OUTBOARD MOTOR

[75] Inventor: Kenichi Hayasaka, Iwata, Japan

[73] Assignee: Yamaha Hatsudoki Kabushiki Kaisha, Iwata, Japan

[21] Appl. No.: 892,358

[22] Filed: Jun. 2, 1992

[30] Foreign Application Priority Data

Jun. 10, 1991 [JP] Japan ..... 3-164941

[51] Int. Cl.[5] ..... B63H 23/06

[52] U.S. Cl. ..... 440/57; 440/76

[58] Field of Search ..... 440/49, 50, 53, 54, 440/55, 56, 57, 58, 59, 60, 61, 76, 77, 900

[56] References Cited

U.S. PATENT DOCUMENTS

| | | | |
|---|---|---|---|
| 3,957,011 | 5/1976 | Hurst | 440/57 |
| 4,565,534 | 1/1986 | Bland | 440/76 |
| 4,642,058 | 2/1987 | Sullivan | 440/57 |
| 4,775,342 | 10/1988 | Conner et al. | 440/57 |
| 4,909,767 | 3/1990 | Hayasaka | 440/57 |
| 4,971,585 | 11/1990 | Bland et al. | 440/76 |

*Primary Examiner*—Joseph F. Peters, Jr.
*Assistant Examiner*—Stephen P. Avila
*Attorney, Agent, or Firm*—Ernest A. Beutler

[57] ABSTRACT

The present invention provides an improved outer surface for an upper region of an encasing arrangement for the outboard unit of a watercraft inboard-outboard propulsion system. Particularly, an independent casing is disclosed which has a relatively smooth, even and continuous outer surface and which is mountable upon a portion of such an outboard unit. The casing mounts in such a manner that its outer surface locates so that it is substantially flush with the outer surface portions of the outboard unit encasement which lie adjacent to the mounted casing. The lack of uneven surfaces, according to the arrangement of the present invention, makes the unit particularly useful in connection with activities which employ a line which is utilized to tow someone or something behind the watercraft, as the line will not snag upon the upper region encasing arrangement.

26 Claims, 7 Drawing Sheets

COVER FOR THE INBOARD-OUTBOARD MOTOR

BACKGROUND OF THE INVENTION

This invention primarily relates to a cover, or encasement, assembly for use with an inboard-outboard watercraft propulsion system. More particularly, the invention provides an improved outer surface for an upper region of an encasing arrangement for the outboard unit of such an inboard-outboard propulsion system.

In order to support the outboard propulsion unit of an inboard-outboard motor, it has been known to employ a bracket unit which is mounted intermediate of the inboard portion of the arrangement and the outboard unit. Typically, such a bracket unit includes a gimbal housing, gimbal ring and swivel bracket. By way of such an arrangement, the outboard propulsion unit may be tilted up and down about a generally horizontal tilt axis and, further, may be swung to the left and right about a generally vertical steering axis.

The outboard propulsion unit generally comprises a number of component parts which must be assembled, and the entire assembly then mounted to the vessel, prior to its use. Of particular interest with respect to the present invention are two major components of such an outboard propulsion unit; namely, the transmission system and the encasement arrangement, and of course, the subparts which make up these components. Although the known transmissions and casings vary somewhat, in order to put together an outboard propulsion arrangement, several typical steps are required. Such steps generally include:

(1) securing the bracket unit proximate the transom of the watercraft;

(2) assembling the various shafts, gears, clutch components, etc. of the transmission system within upper and lower encasement subparts, and subsequently fastening these upper and lower casings together in order to organize them into a unitary arrangement;

(3) securing a plurality of generally horizontally disposed, rearwardly projecting, mounting studs in the swivel bracket;

(4) aligning mounting holes provided within the upper casing subpart of the assembled propulsion unit encasement with the mounting studs on the swivel bracket, so that the mounting studs may pass therethrough, and bringing the forwardmost region of the propulsion unit against the rearwardmost region of the swivel bracket;

(5) initially fastening the assembled propulsion unit against the swivel bracket by lightly screwing fastening nuts onto the mounting studs; and, (6) securely tightening the fastening nuts on the mounting studs by way of a suitable fastening tool (e.g., box wrench), which tool is inserted from a direction rearwardly of the propulsion unit.

Of course certain variations in the assembly steps will be necessitated by the particular choice of components employed; for example, full nut and bolt units may be employed in place of the mounting studs—thereby eliminating the need for step no. 3, set forth above. In such a case, the nut and bolt units would be initially mated at step no. 5 and then fully tightened at step no. 6. However, the above described steps are useful as a generalization of what has traditionally been required in order to assemble a usual arrangement prior to use.

For ease of access in carrying out step no. 6, or its equivalent, it has been the practice to provide a space in the region behind each of the mounting studs or bolts. Such a space has been required to facilitate the insertion or extraction of a nut, a bolt or a fastening tool (depending upon the particular arrangement).

Such an arrangement, and the consequent assembly procedures, have proven to be generally satisfactory in providing a securely mounted outboard unit, of an inboard-outboard motor, proximate the transom of an associated watercraft; nevertheless, certain problems are unfortunately created by the arrangement. For example, the provision of the space behind each mounting stud or bolt, required for installation or removal of a nut, bolt or fastening tool (discussed above), has necessitated arrangements wherein an upper region of the encasement's upper casing portion has an uneven outer surface, or wherein the surface is very narrow. Consequently, the design appearance has been structurally and aesthetically limited or impaired. Structures utilizing an uneven encasement portion also pose problems for aquatic sports or activities which require a tow line to pull a person or object along with the watercraft, such as water skiing. Specifically, the tow line may get caught or snagged upon any region of the encasement's outer surface having any unevenness or irregularity in its surface.

It is, therefore, a principal object of the present invention to provide an improved cover, or encasement, for use with a watercraft propulsion system; and particularly, for an inboard-outboard type propulsion arrangement.

It is also an object of this invention to provide an encasement for an outboard propulsion unit which has a relatively smooth outer surface.

It is still a further object of the invention to provide an encasement assembly which is not unduly limited, or impaired, with regard to its design dimensions.

It is yet a further object of the invention to provide an encasement for an outboard propulsion unit which is suitable for use in connection with activities which employ a line which is towed behind the watercraft.

SUMMARY OF THE INVENTION

A casing is provided for an outboard unit of a watercraft propulsion arrangement for a water vessel. The casing comprises an encasement assembly for the outboard unit, which encasement assembly includes: an upper encasing portion, a plurality of passages formed in the upper encasing portion, and a plurality of fasteners having exposed portions and portions adapted to pass through the passages in order to mount the outboard unit along a rearward region of the vessel. An independent cover member is provided having an inner surface and having a smooth, even, continuous outer surface. The cover member is adapted to surround a substantial region of the upper encasing portion. A plurality of primary mounting units are secured at several locations along the inner surface of the cover member and are adapted to slip over and fit about the fastener exposed portions, thereby mounting the cover member at the upper encasing portion.

DETAILED DESCRIPTION OF THE PREFERRED EMBODIMENT

Figure 1:
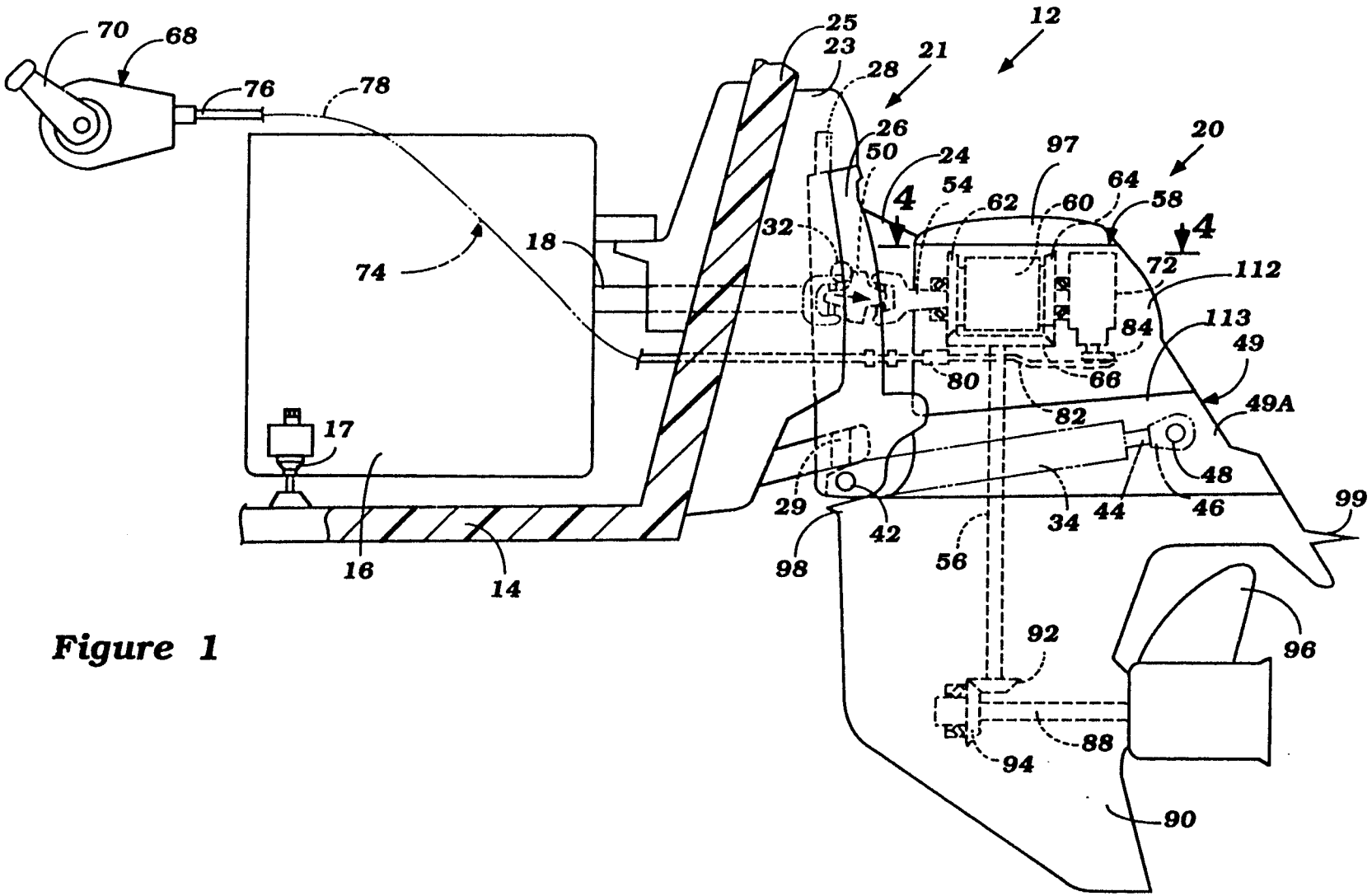
FIG. 1 is a side elevational view of a portion of a watercraft powered by an inboard-outboard drive constructed in accordance with, and embodying, the present invention.

Referring now in detail to the drawings, and initially to FIG. 1, a watercraft powered by an inboard-outboard drive constructed in accordance with the present invention is shown in part and is indicated generally by the reference numeral 12. The watercraft 12 is comprised of a hull 14 in which an internal combustion engine 16, of any suitable type, is positioned via engine mounting units 17. An engine output shaft (not shown) of the engine 16 drives a driven shaft 18 which leads to an outboard drive unit indicated generally by the reference numeral 20.

An intermediate unit 21, or bracket arrangement, is located between the engine 16 and the propulsion unit 20. The intermediate unit 21 is comprised of a number of components, including a transom plate or gimbal housing 23 that is adapted to be affixed, in a known manner, to a transom 25 of the associated watercraft 12. A gimbal ring 26 is affixed to the gimbal housing 23 and is supported for steering movement about a generally vertical axis extending through a tilt bracket 24 and defined by upper and lower pivot shafts 28 and 29, respectively.

The intermediate unit 21 is provided with a pivotal connection 32, at a point along the length of the gimbal ring 26, which defines a generally horizontally extending axis about which the propulsion unit 20 may be pivoted between a plurality of trim and tilt adjusted positions. Such tilt and trim movement of the drive 20 relative to the gimbal ring 26 is controlled by means of a hydraulically operated cylinder assembly 34, with one cylinder located towards each lateral side of the propulsion unit 20. The cylinder assembly 34 includes a pair of cylinder units which are connected to a lower portion of the gimbal ring 26 at one end by means of a pivot shaft 42. A piston rod 44 of each cylinder 34 has a trunion portion 46 that is connected by means of a pivot pin 48 to a rearwardly located portion of an upper casing 49 of the housing of the propulsion unit 20. An oil distributor unit (not shown) is provided for supplying pressurized fluid to a fluid chamber within each cylinder 34 in response to control signals which indicate the tilt or trim position which is desired. As a result, movement of the piston rods 44 will effect pivotal movement of the housing assembly of the propulsion unit 20 about the connection 32.

Figure 2:
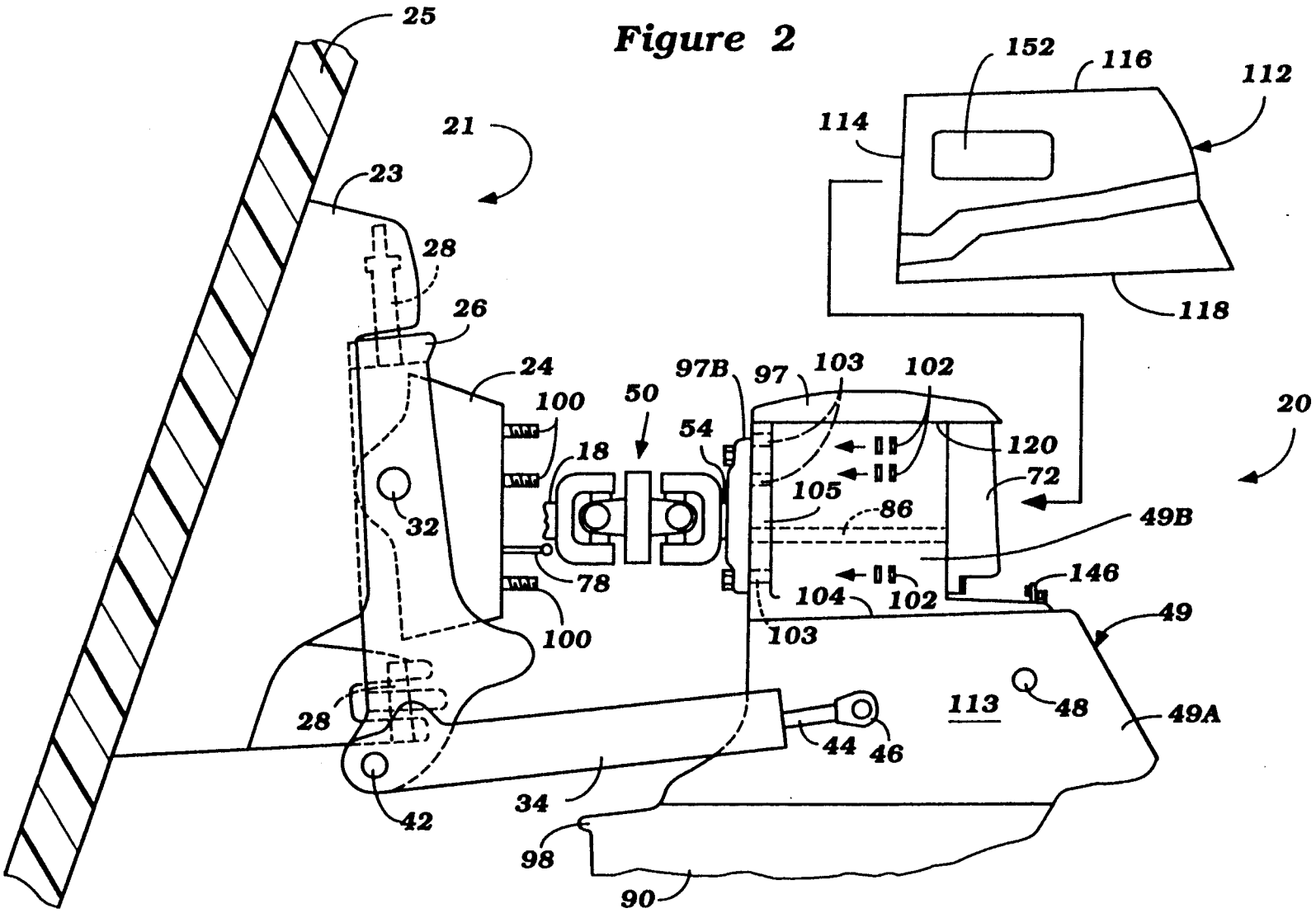
FIG. 2 is an exploded view of the drive of FIG. 1, showing the mounting of an outboard propulsion unit upon an intermediate bracket arrangement.

With additional reference to FIG. 2, it can be seen that the driven shaft 18 of a universal joint 50 extending through the transom 25 is driven by the engine 15 to drive an input shaft 54 of a transmission arrangement for the outboard drive unit 20. The input shaft 54 can selectively drive a drive shaft member 56 by way of a forward, neutral, reverse transmission arrangement, indicated generally by the reference numeral 58, which is described next.

A hydraulic clutch mechanism 60 is mounted upon the input shaft 54. A forward bevel gear 62 and a reverse bevel gear 64 are mounted about the input shaft forwardly, and rearwardly, of the clutch 60, respectively. The forward and reverse gears 62 and 64 are arranged with their toothed faces diametrically opposed with respect to one another. Additionally, the forward and reverse gears 62 and 64 are arranged so that their teeth constantly mesh with teeth of a power input gear 66 which is secured at the upper end of the drive shaft 56 for rotational movement therewith.

A remotely positioned transmission control device 68 is located forwardly of the engine 16, in a region of the watercraft 12 whereat it is readily accessible by an operator. In the depicted embodiment, a hand-operated shifting lever 70 comprises a part of the control device 68, and is selectively moveable in a back and forth direction in order that an operator might arrive at a desired transmission operational state.

The transmission remote control device 68 communicates with a shifting valve device 72, located rearwardly of the reverse bevel gear 64, via a communication line 74. The shifting valve device 72, in turn, is operative to control the positioning of the clutch 60 by way of a hydraulic communication system, including a plurality of hydraulic fluid passages (not shown) bored through the input shaft 54, between these two elements. The shifting valve device 72 includes a hydraulic pump (not shown) formed therein, and operates to selectively direct pressurized hydraulic fluid to the clutch 60 via one of the fluid passage bores to thereby impart appropriate movement to the clutch 60.

Specifically, the hydraulic clutch 60 brings either the forward bevel gear 62 or the reverse bevel gear 64 into engagement with the input shaft 54, depending upon the particular oil passage through which pressurized hydraulic fluid is introduced via the shifting valve 72. In this way, the rotation of the input shaft 54 can be transferred to the drive shaft 56 via the input gear 66. Of course, the transmission arrangement may operate in a neutral condition wherein neither the forward or reverse gears 62 and 64 are engaged to drive the input gear 66.

The communication line 74, extending from the remote transmission control device 68 to the shifting valve device 72, includes a several component parts. A cable is provided having an outer sheath 76 surrounding an elongate inner line 78. A forward end of the outer sheath 76 is fixed at the remote control device 68 and its rearward end is fixed at a location along the region of the swivel bracket 24. The forward end of the inner line 78 is fixed to a portion of the lever 70 so that movement may be imparted to the inner line 78 with shifting of the hand-operated lever 70. The rearward end of the inner line 78 is attached to a bridging connector 80 which communicates the line 78 with a shifting rod 82, extending rearwardly therefrom. Thus, movement of the line 78 is imparted to the rod 82 via the connector 80. The shifting rod 82 controls the movement of a shifting lever 84 which, in turn, controls the shifting valve 72. It should be noted that the inner line 78, the bridging connector 80 and the shifting rod 82 all extend through a guide hole 86 which is formed longitudinally through the upper casing 49 (See FIG. 2) of the propulsion unit 20.

The drive imparted to the drive shaft 56 is transmitted to a propeller shaft 88 by way of a further bevel gear arrangement located in a lower casing of the propulsion unit 20. This further bevel gear arrangement includes a pinion 92 journaled about the lower end of the drive shaft 56 and a bevel gear 94 journaled about a forward portion of the propeller shaft 88. A propeller 96 is fixed at the rearward end of the propeller shaft 88. The propeller 96 is powered selectively via the transmission arrangement, described above, so as to propel the associated watercraft 12 along a body of water as desired.

The upper casing 49 and the lower casing 90 of the propulsion unit 20 not only house the transmission system 58 and its associated elements, set forth above; but additionally, an appropriate exhaust discharge arrangement (not shown) for discharging exhaust gases produced during operation of the engine 16 is, at least partially, housed therein.

The propulsion unit's casings 49 and 90 are made of aluminum alloy die castings. These two casing portions 49 and 90 are securely fastened to one another by way of a plurality of generally vertically extending fastening bolt assemblies (not shown). The finally assembled propulsion unit 20 is streamlined, along its horizontal cross-sectional planes in a direction extending from its forward portions rearwardly, in a manner as to minimize the creation of resistance during movement of the watercraft 12 and propulsion unit 20 along a body of water. The propulsion unit 20 is additionally provided with a splash plate 98 and a cavitation plate 99 formed along certain generally horizontal planes as shown in FIG. 1.

The particular structure and construction of the upper casing 49 of the propulsion unit 20 as contemplated by the present invention will now be described, with additional reference to the remaining Figures.

The upper casing 49 includes a lower portion 49A and an upper portion 49B. The area of the lower portion 49A progressively increases, expanding outwardly, from its uppermost region downward towards its bottom. The upper portion 49B is provided with a generally cubical configuration. The upper portion 49B is narrower in width, when measured in a lateral direction with respect to the associated watercraft 12, than the lower portion 49A. Four, out of the six, faces of the cubical upper portion 49B are provided with openings therethrough. Specifically, openings through the forward and bottom faces are provided for passing various components of the engine power transmission system 58, set forth above. An opening through the top face is provided for allowing the assembly of the power input gear in the upper casing 49B. An opening is provided through the rearward face in order to enable the mounting of the shifting valve 72, which itself then essentially closes off this rearward opening. An opening is provided through the forward face in order to allow the assembly of the hydraulic clutch 60, bevel gears 62 and 64, etc. and is covered by a cover member 97B having a hole for the input shaft passing through.

Figure 6:
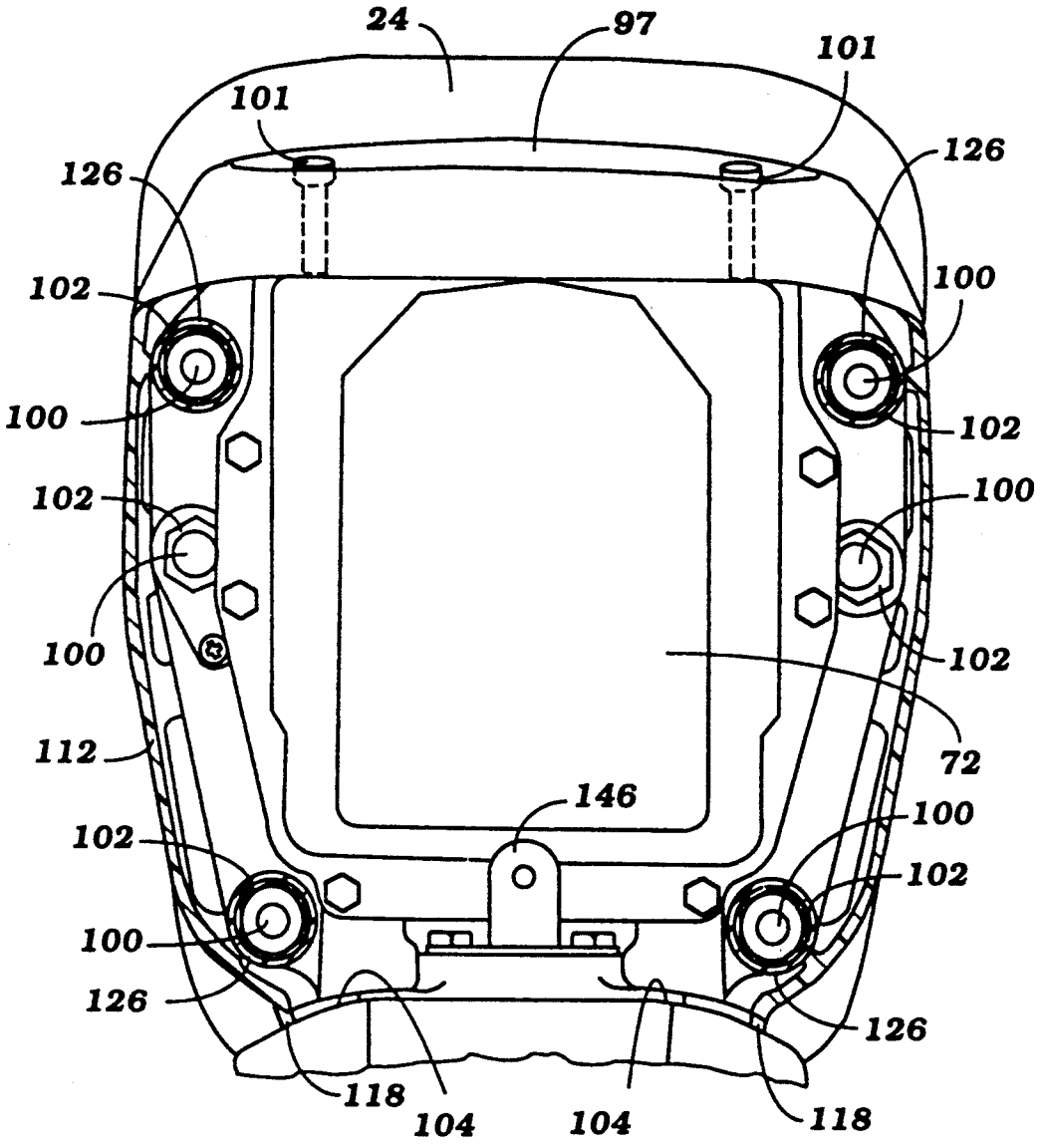
FIG. 6 is a rear view of an upper region of the outboard propulsion unit with part of its cover member broken away.

A cover member 97 is secured to the top of the upper portion 49A of the upper casing 49 through four fastening bolts 101 (See FIG. 6) in order to close off the top opening. The cover member 97 has a slight overhang with respect to the top of the upper portion 49B along its rearwardly and sidewardly located portions. The cover member 97 is made of an aluminum alloy die cast material possessing sufficient strength to withstand against substantial external stresses, for example as when a crew member might step upon it.

The entire propulsion unit 20 is secured against the swivel bracket 24 by way of mounting studs 100 and mating hex nut fasteners 102 (See FIG. 2). A total of six mounting studs 100 are provided, with three of such studs 100 positioned towards each lateral side of the swivel bracket 24. Six corresponding through-holes 103 are bored through a pair of generally vertically disposed, outwardly extending flanges 105, with one such flange 105 being formed off of a forward portion of each lateral side of the upper portion 49B of the upper casing 49. In assembling these elements, the through-holes 103 are aligned with, and pass, the mounting studs 100; and the hex nuts 102 are then fastened upon the mounting studs 100 to secure the propulsion unit 20 in place.

As a result of the differing widths of the lower and upper portions 49A and 49B, a step 104 is formed along the region whereat the lower and upper portions 49A and 49B meet. An access void 106 (See FIGS. 3 and 4) is provided above the step 104 for allowing ready insertion of a fastening tool (e.g., box wrench) from behind the propulsion unit 20 in order to fasten the hex nuts 102 upon the mounting studs 100.

Next, the contemplated procedure for mounting the propulsion unit 20 against the swivel bracket 24 will be described, with particular reference to FIG. 2.

The lower and upper casings 90 and 49 are assembled into a single unit. Additionally, the shifting valve 72 and the top cover members 97 and 97B are positioned and secured in place with respect to the upper casing 49 and the universal joint is fixed to the input shaft 54. The propulsion unit 20, thus assembled, is then brought towards the swivel bracket 24 from a direction rearwardly thereof. The driven shaft 18 of the universal joint 50 is inserted through the gimbal housing 23 and the transom 25 so as to be connected with the output shaft of the engine via a spline connection. The through-holes 103 are aligned with the mounting studs 100 so that the mounting studs 100 will pass therethrough. The hex nuts 102 are then initially fastened relatively lightly upon the mounting studs 100. Preferably, the nuts 102 are of a self-locking type. Finally, the hex nuts 102 are tightened upon the mounting studs 100 by way of a box wrench, or the like, which is inserted from behind the propulsion unit 20, specifically through the access void 106, to securely fix the propulsion unit 20 against the rearward face of the swivel bracket 24. At the same time, the trunion portions 46 are connected with the pivot pins 48, provided at both sides of the upper casing 49, and the line 78 is connected with the rod at the connector 80.

A cover member 112 is provided for attachment to the propulsion unit 20, in the vicinity of the upper casing 49, in order to provide the arrangement with a smooth, generally continuous, outer surface 113. The cover member is basically U-shaped along its horizontal cross-section, and is comprised of any suitable resin material.

More specifically, with regard to the structural features of the cover member 112, the two forwardmost edges 114 of the cover member are located along a pair of straight vertical lines, when the cover member 112 is viewed from the side and in its contemplated mounting orientation. The upper portion 116 of the cover member 112 lies along a single plane and the lower portion 118 lies along another plane. The planes along which the upper 116 and lower 118 portions lie are not parallel; but rather, they tend to approach one another, slightly, in a rearward direction with respect to the associated watercraft 12.

The cover member 112 is designed to fit upon the upper portion of the upper casing 49 in a direction as shown by the blackened arrow of FIG. 2. The dimensions of the cover member 112 are preferably such that, when it is in place upon the propulsion unit 20, its forward edges 114 locate closely adjacent the rearward face of the swivel bracket 24, with only a small gap remaining between these two elements. The upper portion 116 is arranged so that it will locate adjacent a lower ridge 120 of the top cover member 97, with only a small gap separating these two portions as well. In a similar fashion, the lower portion 118 is arranged so that it will locate adjacent the step portion 104, whereat the lower 49A and upper 49B portions of the upper casing 49 meet, with only a small gap interposed between the lower portion 118 and the step 104. The outward facing surfaces of the cover member 112 are designed such that they will be flush with the adjacent lying surfaces of the propulsion unit 20, when the cover member 112 is in place.

The structural arrangement for mounting the cover member 112 upon the upper casing 49, will now be described.

Figure 4:
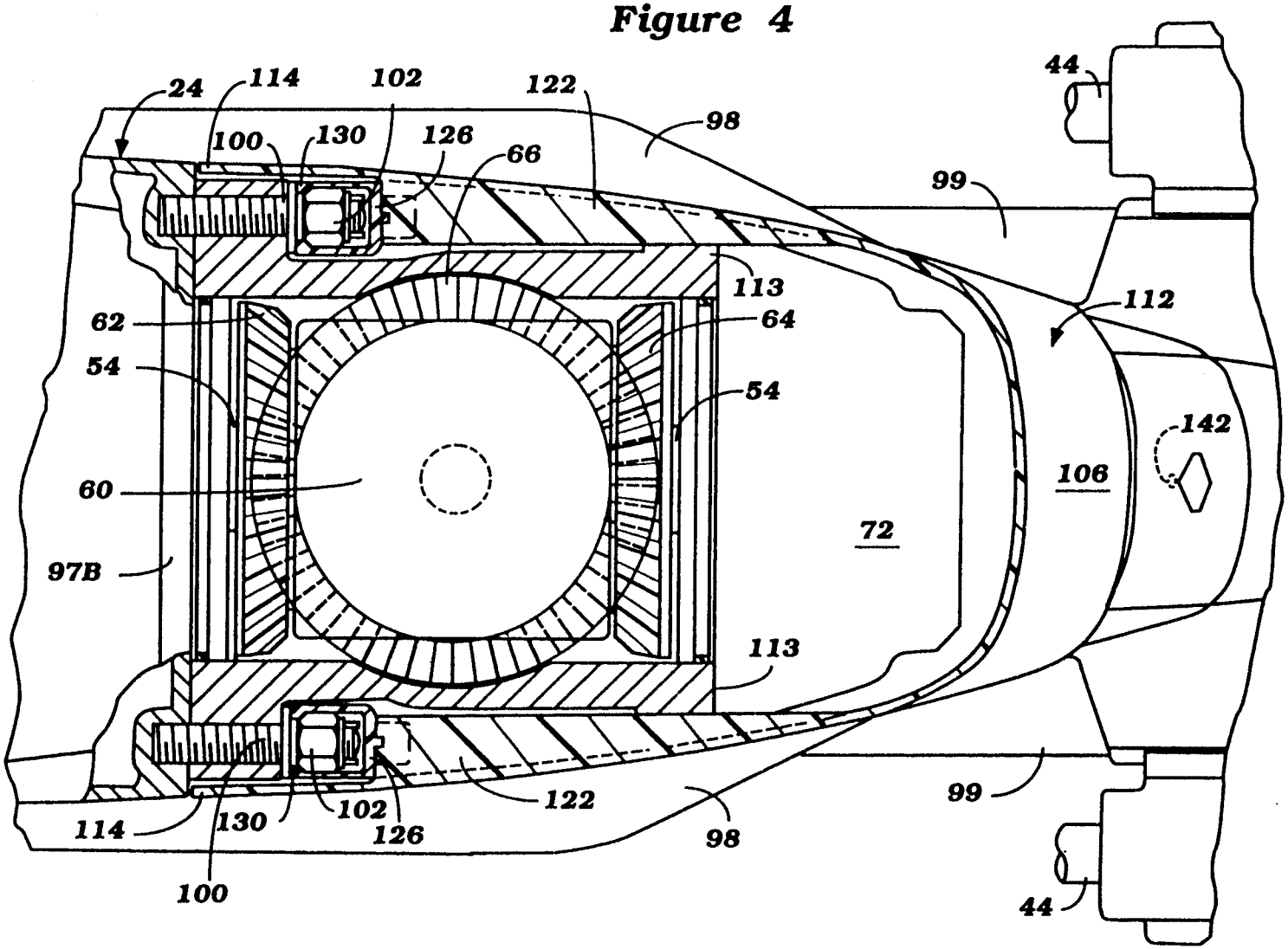
FIG. 4 is a cross-sectional view taken along the line 4—4 of FIG. 1.
Figure 5:
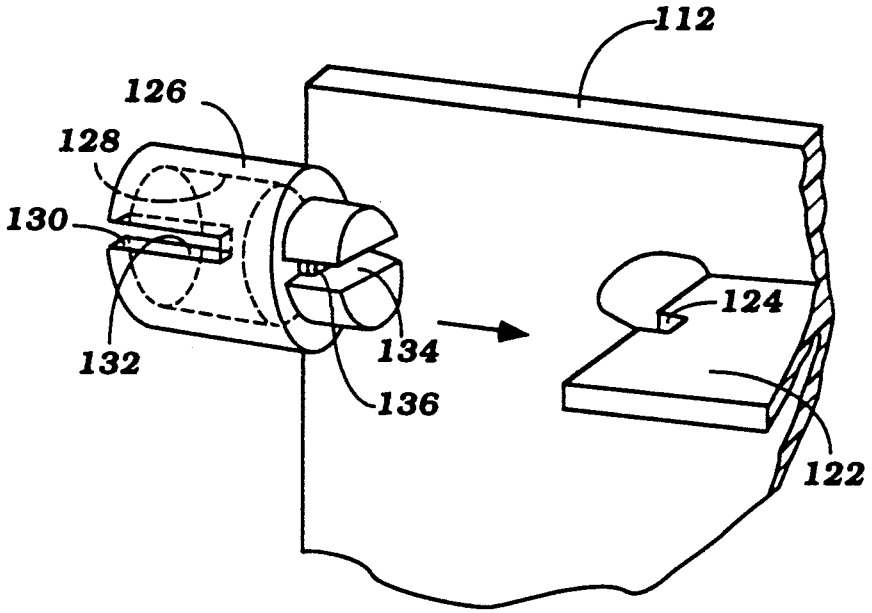
FIG. 5 is a perspective view showing a mounting mechanism located along a forward region of the cover member of the outboard propulsion unit.

Four generally horizontally disposed plates 122, as shown in part in FIGS. 4 and 5, are provided with two positioned towards each side of the U-shaped cover member 112. A cutout 124 is formed along a forward edge of each of the plates 122, as best seen in FIG. 5.

A cylindrical member 126 is also provided and is adapted to fit upon the front edge of each plate 122. A cylindrical bore 128 is provided through a portion of each cylindrical member 126 from the forwardmost face rearwardly, along a longitudinal direction. A rather small, circular, inwardly extending flange 130 is provided about the inner circumference of the forwardmost region of the bore 128, thereby providing this particular portion with a diameter which is less than that possessed by the remainder of the bore 128. A slit 132 extends through a wall of each cylindrical member 126 from the forwardmost portion of the cylindrical member 126 rearwardly, in a longitudinal direction. A generally horizontal cutout 134, which extends laterally across the cylindrical member 126 at its rearwardmost region, is provided so that the cylindrical member 126 may be snugly fitted upon a forward edge of the horizontal plate 122, as indicated by the arrow of FIG. 5. A small projection 136 is formed approximately midway across the lateral width of the cutout 134 so that it will be received in the cutout 124 of the plate 122 upon fitting the cylindrical member 126 thereon.

An adhesive is applied to certain portions of the cylindrical member 126 and the horizontal plate 122 which contact one another upon fitting these two members together in order that a secure bond will be established therebetween and these elements will be able to function as a single unit. The four assembled plate (122)/cylinder (126) combinations comprise one type of means for attaching the cover member 112 upon the upper casing 49. An additional attaching means will now be described.

Figure 3:
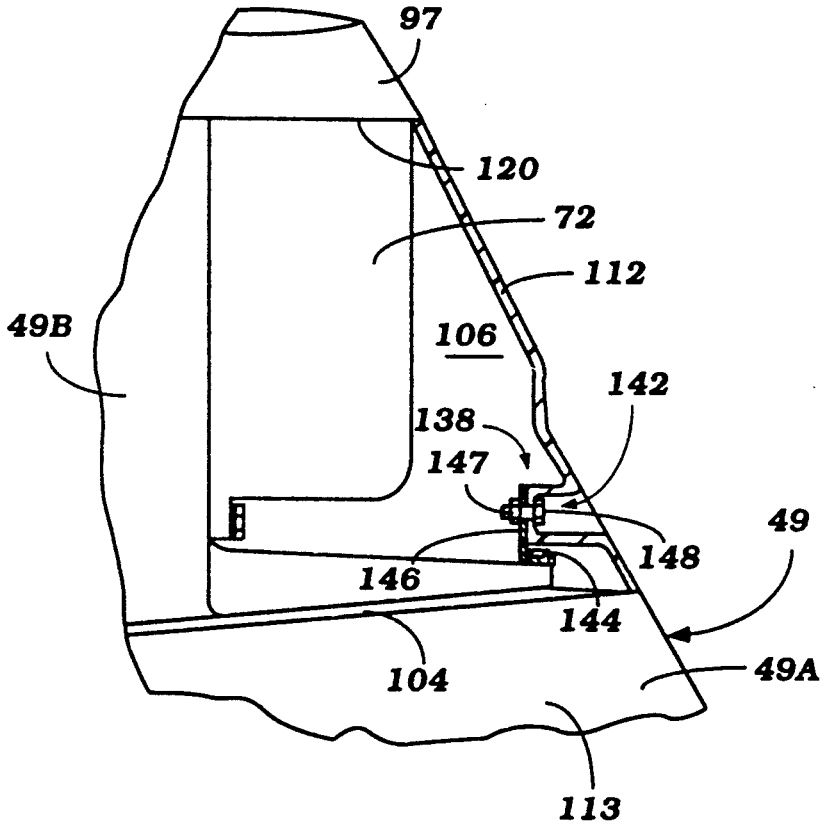
FIG. 3 is an enlarged side view, with portions shown in section, of a cover member mounted upon an upper region of the outboard propulsion unit, as shown in FIG. 1.

The additional means for attaching the cover member 112 upon the upper casing 49 is provided along a rearward region of the upper casing 49, and is indicated generally in FIG. 3 by the reference numeral 138. A mounting hole 142 is integrally formed within a wall of the cover member 112 along a rearward, lower region thereof. Specifically, the mounting hole 142 extends forwardly from a rearward surface of the cover member 112. Bolt members 144 secure an L-shaped bracket 146 upon a region of the casing proximate the step portion 104 and rearwardly of the shifting valve 72. A nut 147 is secured to a generally vertical, forwardly facing side of the bracket 146, as by way of a weld. Accordingly, a mating bolt 148 is able to secure the cover member 112 in place upon fastening it within the nut 147, as is readily apparent in FIG. 3.

Next, the procedure, as contemplated by the present invention, for assembling the cover member 112 upon the upper casing 49 will be described.

The cover member 112 is inserted into place upon the upper casing 49 in a direction from a region rearwardly of the propulsion unit 20, as depicted in FIG. 2, by way of pushing it in forwardly with a slight twisting movement. In this way, the leading edge of each cylindrical bore 128 of each cylindrical member 126 is brought into proximity with a corresponding secured hexagonal fastening nut 102, which nuts 102 hold the propulsion unit in place against the swivel bracket 24 as set forth above. Upon pressing the cover member 112 further forward, the opposing faces of the longitudinal slits 132, running along the longitudinal length of the cylindrical members 126, are spread apart somewhat, thereby allowing the circumferential size of the leading edges of the bores 128 to expand so that the cylindrical members 126 may slide over the nuts 102. It should be noted, in particular, that the reduced diameter portion of each of the bores 128, specifically at locations along the inwardly directed flanges 130, slide across the entire longitudinal length of each corresponding nut 102 as the cover member 112 is pushed forwardly into its assembled position. Once each entire nut 102 is received within a corresponding cylindrical member 126, each cylindrical member 126 snaps back towards its original size, from its expanded condition, and the flanged portions 130 then engage an outer portion of the forward face of each nut 102. Accordingly, the cover member 112 is securely held in place by such action.

After snapping the cylindrical members 126 upon the hexagonal nuts 102 in the fashion just discussed, the rearward fastening mechanism 138 is secured. Specifically, the bolt 148, set forth above, is passed through the mounting hole 142 of the cover member 112 and is fastened into the nut 147, which is secured with respect to the L-shaped bracket 146. Thus, the cover member 112 is yet further securely held in place upon the upper casing 49 by this mechanism.

Several advantages are recognized by the above construction and the contemplated manner of assembling the various components. For example, the described arrangement is self-sufficient in securely holding the cover member 112 in place upon the upper casing 49, so no special fasteners necessitating access holes bored through the cover member in order to pass fastening devices are required. Since the cover member 112 is allowed to remain free of such passages formed through its surface, and since the outward facing surfaces of the cover member 112 are designed such that when the cover member 112 is in place they will be flush with, and closely adjacent to, the surfaces of the propulsion unit 20 which surround it, audible meshing noises emanating from the operation of the transmission bevel gears 62 and 64 are minimized.

Additionally, the cover member 112, and particularly its associated cylindrical member (126)/horizontal plate (122) fastening units, aid in protecting the nuts 102 and mounting studs 100 against potentially damaging exposure to certain elements (e.g., corrosive salt water) within the environment in which the watercraft 12 is operated. The general structure of cover member 112 provided by the invention, and the mechanisms which permit it to be readily secured upon the upper casing 49, are quite suitable for use with an arrangement which employs a relatively lengthy distance, measured laterally with respect to the associated watercraft, between the studs which mount the propulsion unit against the rear face of the swivel bracket. That is, the present cover member 112 would protect mounting studs positioned in such a manner against potentially damaging externalities. Such an arrangement for the mounting studs is desirable in that it can provide a relatively high degree of stability against laterally imposed stress loads incurred during steering operations of the watercraft.

An information bearing and indicating sticker 152 can be adhered upon a side of the cover member 112, as shown in FIG. 2. Such a sticker would constantly remain visible to an operator, or other pertinent individual, since this region always remains above the surface of the body of water within which the watercraft 12 is operated. Additionally, with the present construction, it is not necessary to place such a sticker 152 rearwardly of, or away from, the mounting studs 100 (as has conventionally been the case) because the cover member 112 lies laterally outward of these members. In many prior arrangements, the mounting studs have posed the problem of blocking the view of a sticker which might be placed on the propulsion unit in their immediate vicinity. Thus, there is provided by the present invention a wide degree of freedom in selecting a location upon the upper casing 49 of the propulsion unit 20 at which to place such an information indicating sticker 152.

If, due to some inadvertency, the fastening mechanisms (i.e., the hex nuts 102 and engaging portions of the cylindrical members 126; the components of the rearwardly located fastening arrangement 138; etc.) holding the cover member 112 in place against the upper casing 49 become stuck (e.g., by corrosion) it is nevertheless possible to remove the cover member 112, when necessary, according to the present invention. Specifically, upon unfastening the bolts 101 and removing the top cover 97, any suitable tool may be inserted along the top of the cover member 112 in order to pry it off of the upper casing 49. Of course, some damage to the cover member 112 might be incurred if such action were required, but at least the cover member 112 may be removed, and the propulsion unit 20 dismounted, if the need should arise under such circumstances.

Figure 7:
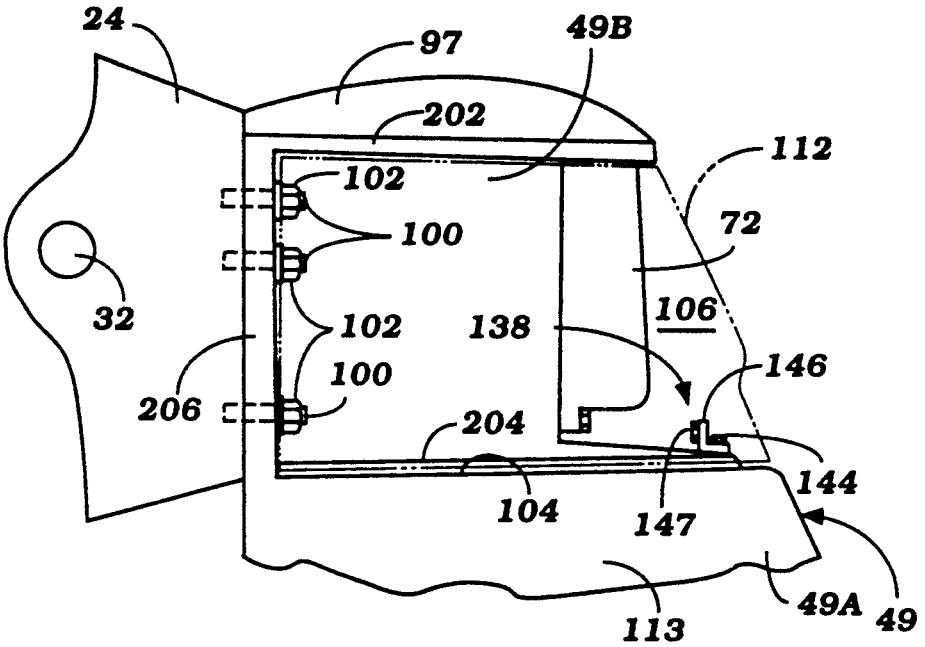
FIG. 7 is a partial side view of the propulsion arrangement, in accordance with a second embodiment of the invention, with its cover member depicted in phantom.

A second embodiment of the present invention is depicted in FIG. 7, and is described next. The second embodiment is essentially the same in many respects as the embodiment set forth above and shown in FIGS. 1 through 6. Accordingly, the second embodiment will be described only to the extent necessary to convey those features which differ from the features already set forth. Like reference numerals are employed below to indicate like elements utilized in both embodiments.

According to the second embodiment, the upper portion 49B of the upper casing 49 is provided with several flanged areas. Specifically, a pair of upper flanges 202 are provided along each side of the top of the upper portion 49B, and a pair of lower flanges 204 are provided along each side of the bottom of the upper portion 49B. Both upper and lower flanges 202 and 204 extend continuously, in a V-shaped fashion, rearwardly from a pair of forwardly located flange portions 206 which are provided with one to each lateral side of the upper portion 49B. All of the flanged portions, just set forth, are formed integrally with the upper casing 49 and are provided with smooth, continuous configurations.

The cover member 112 of the second embodiment is essentially the same as that discussed above with reference to the first embodiment. The cover member 112 is mounted upon the upper casing 49 so that all of its edges locate close to the flanges 202, 204 and 206, with only small gaps interposed therebetween. Also, the cover member 112 is arranged so that its outer surfaces will be flush with the surfaces of the flanged regions 202, 204 and 206, once mounted.

The foregoing description is, of course, only that of the preferred embodiments of the invention, and various changes and modifications may be made without departing from the spirit and scope of the invention, as defined by the appended claims.

It is claimed:

1. A casing for an outboard unit of a watercraft propulsion arrangement for a water vessel, comprising: an encasement assembly for said outboard unit, wherein said encasement assembly includes an upper encasing portion; a plurality of passages formed in said upper encasing portion; a recess formed in said upper encasing along the region of said passages; a plurality of fasteners having exposed portions and portions adapted to pass through said passages in order to mount said outboard unit along a rearward region of said vessel; an independent cover member having an inner surface and having a smooth, even, continuous outer surface, said cover member being adapted to surround a substantial region of said upper encasing portion; a plurality of primary mounting units secured at several locations along said inner surface of said cover member and adapted to slip over and fit about said fastener exposed portions, thereby mounting said cover member at said upper encasing portion within said recess.

2. The casing of claim 1 wherein said outer surface of said cover member is located laterally outward of said fasteners.

3. The casing of claim 2 further comprising an indicating label secured upon said outer surface of said cover member.

4. The casing of claim 1 wherein said outer surface of said cover member is substantially flush with adjacent outer surfaces of said upper encasing portion in the region whereat said cover member is mounted.

5. The casing of claim 4 wherein a substantial portion of said inner surface of said cover member is separated from said upper encasing portion about which said cover member is mounted, thus defining an access area therebetween; said access area suitable for accessing said fasteners when said cover member is not mounted upon said upper encasing portion.

6. The casing of claim 4 further comprising a bracket interposed between said vessel and said outboard unit; wherein said outboard unit mounts to said bracket via said fasteners and said bracket is mounted against a rearward region of said vessel.

7. The casing of claim 6 wherein said bracket is a swivel bracket having a rearward face; wherein said outboard unit is mounted against said rearward face.

8. The casing of claim 6 wherein said cover member has an upper edge and a lower edge and two forward edges; wherein said upper edge and said lower edge locate very close to adjacent portions of said upper encasing portion upon mounting said cover member; and wherein said forward edges locate very close to adjacent portions of said bracket upon mounting said cover member.

9. The casing of claim 8 wherein a very small gap is interposed between said upper and lower edges and said adjacent portions of said upper encasing; and wherein a very small gap is interposed between said forward edges and said bracket.

10. The casing of claim 4 further comprising an additional mounting unit which includes a passage located through a rearward portion of said cover member and a brace attached to said encasement; said additional mounting unit also including a threaded fastening arrangement adapted to pass through said rearward passage of said cover member and a portion of said brace, in order to secure said cover member against said brace.

11. The casing of claim 4 wherein each of said primary mounting units comprises a cylindrical member having an opening extending from its forwardmost portion rearwardly along its longitudinal direction; said opening being adapted to slip over and fit about one of said fasteners.

12. The casing of claim 11 wherein each of said primary mounting units further comprises a flange extending radially inward from the inner circumference of a forwardly located portion of said opening; said flange being adapted to securely engage a portion of one of said fasteners.

13. The casing of claim 12 further comprising a slit formed longitudinally through a wall of said cylindrical member from a forwardmost region thereof rearwardly; said slit having opposing adjacent faces which may be separated from one another in order to increase the size of said opening.

14. The casing of claim 13 further comprising plates extending off of said inner surface of said cover member; wherein said cylindrical members are secured to said plates.

15. The casing of claim 4 wherein said cover member has a generally U-shaped configuration along its horizontal cross-section.

16. The casing of claim 15 wherein said upper encasing portion has a generally cubical configuration.

17. The casing of claim 16 wherein said upper casing houses a clutch mechanism and bevel gears of a transmission assembly.

18. The casing of claim 17 wherein said watercraft propulsion arrangement is of the inboard-outboard type.

19. The casing of claim 4 wherein said fasteners comprise mating nut and bolt assemblies.

20. The casing of claim 4 wherein said fasteners include mounting studs secured in said bracket, said mounting studs extending in a generally rearward direction, and further including nuts adapted to securely mate with said mounting studs; and wherein each of said primary mounting units fastens upon a corresponding nut, upon mounting said cover member.

21. An encasement assembly for an outboard unit of a watercraft propulsion arrangement, comprising: an encasing portion for said outboard unit, said encasing portion having a generally vertical extending side-wall; an elongate recess extending laterally inward from an outer surface of said side-wall, wherein said recess spans in a generally horizontal fashion about a substantial region of said encasing portion; and further comprising an independent cover member adapted to mount securely within the entire recess so that said cover member is generally flush with the outer side-wall surface of said encasing portion.

22. The encasement assembly of claim 21 wherein said recess is generally C-shaped.

23. The encasement assembly of claim 22 further comprising a plurality of passages formed along a forwardly located region of said encasing portion; a plurality of fasteners having exposed portions and portions adapted to pass through said passages in order to mount said outboard unit along a rearward region of said vessel; wherein said cover member is adapted to slip over and fit about said fastener exposed portions.

24. The encasement assembly of claim 23 wherein inner boundaries of said generally C-shaped recess are located within an upper region of said encasing portion.

25. The encasement assembly of claim 24 wherein said inner boundaries of said generally C-shaped recess are defined in part by a top cover member which is secured across the top of said upper region of said encasing portion.

26. The encasement assembly of claim 25 wherein said top cover member possesses greater strength and rigidity than that of said encasing portion to which it is secured as well as said independent cover member.

* * * * *